US009803883B2

(12) United States Patent
Fan et al.

(10) Patent No.: US 9,803,883 B2
(45) Date of Patent: Oct. 31, 2017

(54) ENVIRONMENTAL CONTROL SYSTEM

(75) Inventors: Junqiang Fan, Glastonbury, CT (US); Futao Zhao, Farmington, CT (US); Stevo Mijanovic, South Windsor, CT (US); Rajendra K. Shah, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 876 days.

(21) Appl. No.: 13/984,973

(22) PCT Filed: Feb. 6, 2012

(86) PCT No.: PCT/US2012/023925

§ 371 (c)(1),
(2), (4) Date: Jul. 17, 2014

(87) PCT Pub. No.: WO2012/112324

PCT Pub. Date: Aug. 23, 2012

(65) Prior Publication Data

US 2016/0195297 A1 Jul. 7, 2016

Related U.S. Application Data

(60) Provisional application No. 61/442,550, filed on Feb. 14, 2011.

(51) Int. Cl.
*F24F 3/00* (2006.01)
*F24D 19/10* (2006.01)
(Continued)

(52) U.S. Cl.
CPC ..... *F24F 11/02* (2013.01); *F24F 3/044* (2013.01); *F24F 11/0078* (2013.01);
(Continued)

(58) Field of Classification Search
CPC ..... F24F 11/006; F24F 11/053
(Continued)

(56) References Cited

U.S. PATENT DOCUMENTS 5,298,845 A * 3/1994 DeBoer ..... G05B 11/42 318/609
6,964,174 B2 * 11/2005 Shah ..... F24F 13/02 165/205
(Continued)

FOREIGN PATENT DOCUMENTS

DE 4424652 A1 1/1996
DE 19601453 A1 7/1996
(Continued)

OTHER PUBLICATIONS

International Search Report mailed Jun. 12, 2012 for PCT/US2012/023925 filed Feb. 6, 2012, pp.
(Continued)

*Primary Examiner* — Len Tran
*Assistant Examiner* — Paul Alvare
(74) *Attorney, Agent, or Firm* — Cantor Colburn LLP

(57) ABSTRACT

An environmental control system is provided and includes equipment to generate an environmental control effect, a damper associated with a zone to control a portion of the environmental control effect permitted to affect the zone by assuming one of various damper positions and a capacity controller operably coupled to the equipment and the damper to control operation of the equipment and to adjust the damper to assume the one of the various damper positions based on a demand of the zone and a capacity of the equipment.

18 Claims, 4 Drawing Sheets

(51) Int. Cl.

| | |
|---|---|
| ***F24F 11/00*** | (2006.01) |
| ***G05D 23/275*** | (2006.01) |
| ***G05B 13/02*** | (2006.01) |
| ***F25D 19/00*** | (2006.01) |
| ***F24F 11/02*** | (2006.01) |
| ***F24F 13/24*** | (2006.01) |
| ***F24F 3/044*** | (2006.01) |
| *F24F 11/053* | (2006.01) |

(52) U.S. Cl.
CPC ..... *F24F 11/022* (2013.01); *F24F 13/24* (2013.01); *F24F 11/006* (2013.01); *F24F 11/053* (2013.01)

(58) Field of Classification Search
USPC ..... 700/37; 165/217; 236/1 B; 62/296
See application file for complete search history.

(56) References Cited

U.S. PATENT DOCUMENTS

| | | | | |
|---|---|---|---|---|
| 7,377,450 | B2 | 5/2008 | Ostrand et al. | |
| 8,033,479 | B2 * | 10/2011 | Kates | F24F 11/006 236/1 B |
| 2004/0228051 | A1 * | 11/2004 | Dragoi | H02H 7/093 361/23 |

FOREIGN PATENT DOCUMENTS

| | | | |
|---|---|---|---|
| DE | 10337606 | A1 | 3/2005 |
| EP | 1840476 | A2 | 10/2007 |

OTHER PUBLICATIONS

Written Opinion mailed Jun. 12, 2012 for PCT/US2012/023925 filed Feb. 6, 2012, pp.

* cited by examiner

ENVIRONMENTAL CONTROL SYSTEM

CROSS REFERENCE TO RELATED APPLICATION

This application is a National Stage Application of PCT Application No. PCT/US2012/023925 filed Feb. 6, 2012, which is a PCT Application of U.S. Provisional Patent Application No. 61/442,550 filed Feb. 14, 2011, the disclosures of which are incorporated by reference herein in their entireties.

BACKGROUND OF THE INVENTION

The subject matter disclosed herein relates to an environmental control system and, more particularly, a multi-zone temperature control system.

A typical heating, ventilation and air conditioning (HVAC) system with multi-zone temperature control targets includes a multi-stage or variable speed heat pump (HP), a blower and multiple dampers. In a heating mode, a furnace may be used to replace the HP to provide heat or an electrical heater may be used to supplement the HP to provide heat in cold weather.

Often, HVAC systems further include zone controllers and a system demand controller. Individual zone controllers are respectively associated with temperature control in each zone and may employ a damper to control the zone temperature based on information about the temperature setpoint and each zone temperature measurement. By contrast, the system demand controller is used to control the HP (or the furnace or the electrical heater) based on a total demand of each zone (i.e., the difference between zone temperature and its setpoint for each zone).

A typical HVAC system is described in U.S. Pat. No. 7,377,450, the entire contents of which are incorporated herein by reference, and is shown schematically in FIG. 1. Such a system includes a heat pump 10 to supply refrigerant to a coil 11 and a blower 12. The blower 12 blows air over the coil 11 to cool the air in a cooling mode or to heat the air in a heating mode, and the air is then directed to ductwork 13 that is fluidly coupled to zones 1-6 (here 6 zones are only used for illustration purpose and could be single or multiple zones in fewer or greater numbers). The cooled or heated air is supplied to the zones 1-6 via dampers 1-6, which are respectively associated with each of the zones 1-6. Sensors within each zone measure temperatures therein with those measured temperatures subsequently employed in the calculation of zone errors based on predefined setpoints. The zone errors and noise limits for each zone are provided to system demand controller 14, which is coupled to the heat pump 10 and which may be a heat pump proportional integral (PI) controller, and the zone controllers 15, which are coupled to each of the dampers 1-6 and which may be PI controllers for each of the dampers 1-6.

The zone errors define the demand for heat pump 10 capacity and the noise limits define an amount of air to be permitted to flow into each of the zones 1-6 via the dampers 1-6. Thus, if there is an increased demand for heat pump 10 capacity, the system demand controller 14 will instruct the heat pump 10, the coil 11 or the blower 12 to output more cooled air in cooling mode or heated air in heating mode to the ductwork 13. By contrast, the zone controllers 15 will open or close each of the dampers 1-6 based on whether the air flow into the zones 1-6 exceeds the noise limits for each respective zone.

With the configuration described above, it is possible that the system demand controller 14 could be driven to provide too much heating/cooling capacity to the zones 1-6 even though such capacity cannot be delivered to the zones 1-6 by the corresponding zone controllers 15 due to air flow constraints imposed by the noise limits on each zone. For such cases, the current HVAC systems employ system demand controllers 15 that are forced to use exceptional rules to satisfy the air flow constraints.

BRIEF DESCRIPTION OF THE INVENTION

According to one aspect of the invention, an environmental control system is provided and includes equipment to generate an environmental control effect, a damper associated with a zone to control a portion of the environmental control effect permitted to affect the zone by assuming one of various damper positions and a capacity controller operably coupled to the equipment and the damper to control operation of the equipment and to adjust the damper to assume the one of the various damper positions based on a demand of the zone and a capacity of the equipment.

According to another aspect of the invention, a multi-zone environmental control system is provided and includes equipment to generate an environmental control effect, a plurality of dampers respectively associated with a plurality of zones to each control a portion of the environmental control effect permitted to affect the corresponding one of the plurality of zones by assuming corresponding ones of various damper positions and a capacity controller operably coupled to the equipment and the plurality of dampers to control operation of the equipment, the capacity controller including a plurality of zone controllers to adjust each of the dampers to assume the corresponding ones of the various damper positions based on a demand of the corresponding one of the plurality of zones and a capacity of the equipment.

According to yet another aspect of the invention, a method of operating a capacity controller in a multi-zone environmental control system is provided and includes converting zone demands for an environmental control effect of each zone of a plurality of zones into a demand signal and an available capacity signal, controlling an operational speed of equipment to provide the environmental control effect based on the demand signal and adjusting each damper of a plurality of dampers respectively associated with each of the plurality of zones to assume in accordance corresponding ones of various damper positions based on the demand signal and the available capacity signal.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
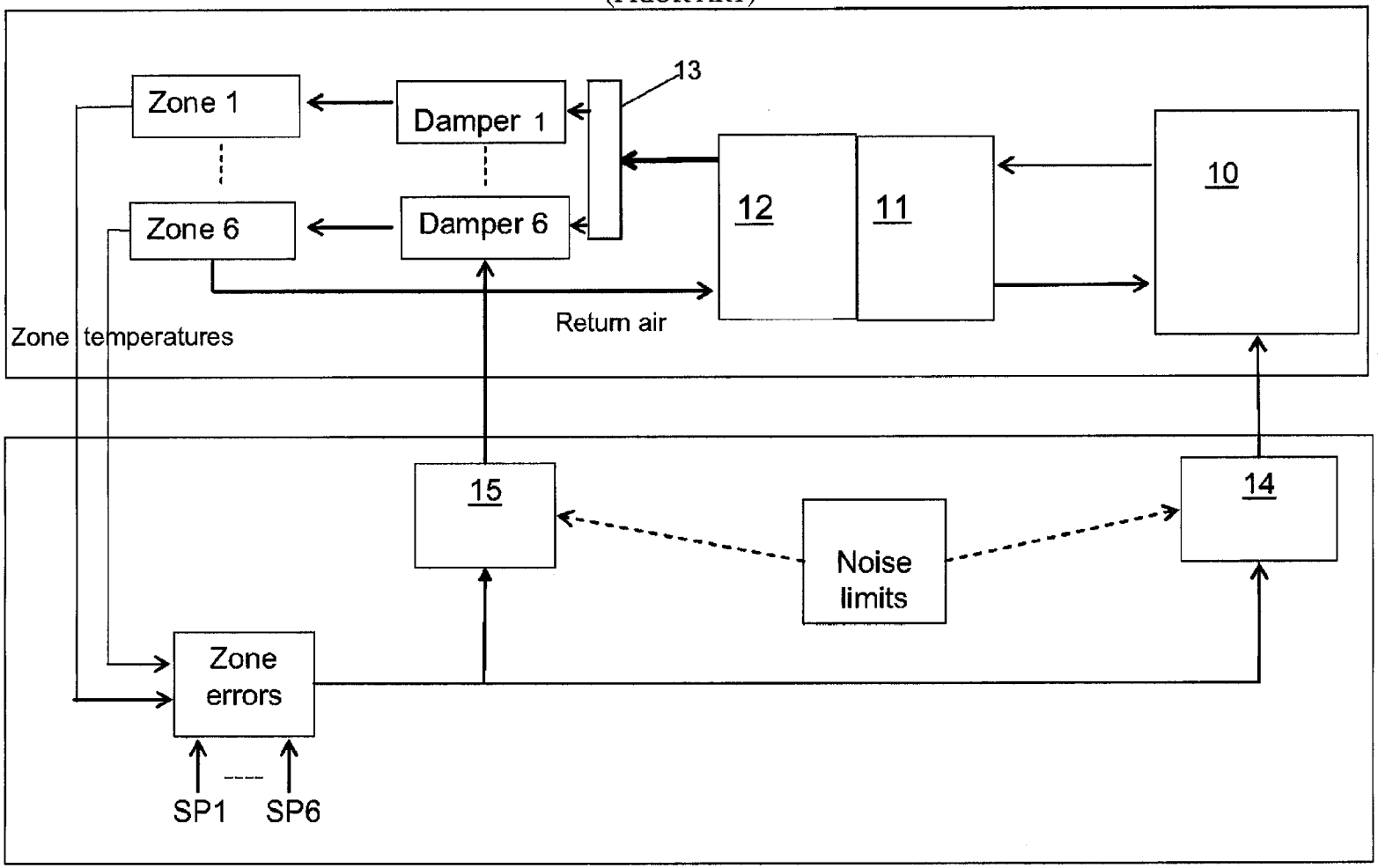
FIG. 1 (PRIOR ART)
FIG. 1 is a schematic illustration of a typical heating, ventilation and air conditioning (HVAC) system of the prior art.
Figure 2:
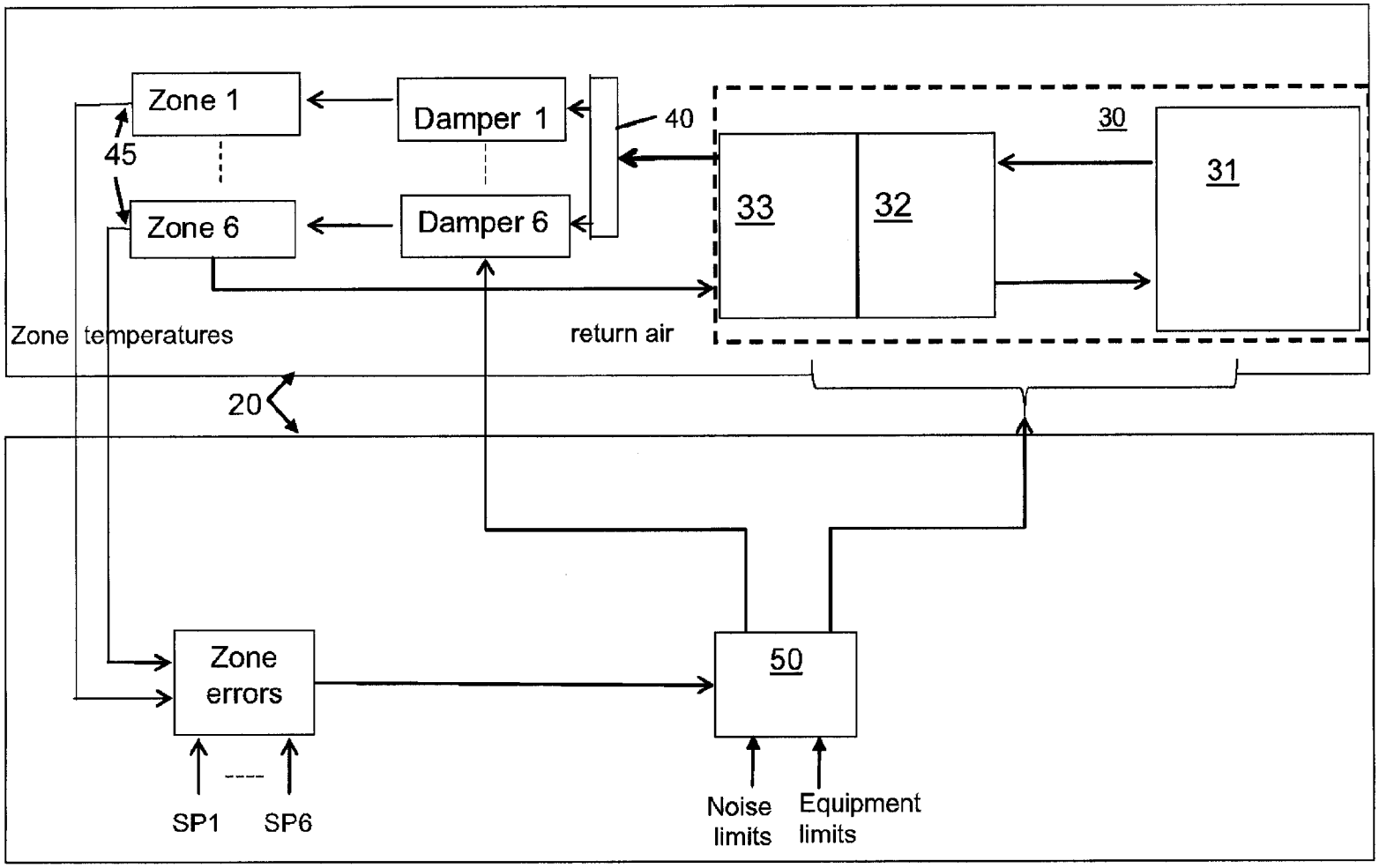
FIG. 2 is a schematic illustration of a temperature control system including a capacity controller in accordance with embodiments.

In accordance with aspects of the invention, a systematic control method for multi-zone environmental control systems, HVAC systems or temperature control systems with different configurations of environmental condition affecting or heating/cooling equipment is provided and permits explicit and effective handling of air flow limits and equipment capacity. FIG. 2 shows the capacity orientated control architecture for a 6-zone HVAC environmental control system 20 although it is to be understood that the capacity oriented control architecture can be applied to any HVAC environmental control system with 1 or more zones.

As shown in FIG. 2, the system 20 includes environmental condition affecting equipment that generates an environmental control effect. As an example, the environmental affecting equipment may include heating/cooling equipment 30 or another similar type of equipment. For clarity and brevity, the heating/cooling equipment 30 will be described below although it is to be understood that the description is merely exemplary.

The heating/cooling equipment 30 includes a heat pump 31 or a furnace or an electric heater, a coil 32 and a blower 33. The heat pump 31 supplies cooled refrigerant to the coil 32 (used as an evaporator) and the blower 33 blows air over the coil 32 to cool the air in a cooling mode or, in a heating mode, the heat pump 31 supplies heated refrigerant (in vapor) to the coil 32 (used here as a condenser) and the blower 33 blows air over the coil 32 to heat the air. The amount of cooling/heating achieved by the heating/cooling equipment 30 is related to capacity demand and can be influenced by how fast the blower 33 is operated.

The cooled/heated air is then supplied as a generated air flow to ductwork 40 and from the ductwork 40 to zones 1-6 via dampers 1-6, which are respectively associated with each zone. The dampers 1-6 are each configured to control a portion of the air flow flowing into the corresponding one of the zones 1-6 by assuming one of various damper positions. Previously cooled/heated air is removed from the zones 1-6 and returned to the heating/cooling equipment 30 while temperature measurements are taken by sensors 45 operably disposed within each zone. The temperature measurements are compared with predefined setpoints for each zone such that a zone demand for each zone can be calculated as $T_i-T_{spi}$ for cooling situations and $T_{spi}-T_i$ for heating situations, where $T_i$ is an actual temperature within a zone and $T_{spi}$ is a predefined corresponding setpoint. As mentioned previously, zone demand does not have to be related to particular zone temperatures alone or even to zone temperatures. A zone demand value may also be placed on, for example, zone humidity, zone air quality/filtering and/or some combination thereof.

The system 20 further includes a capacity controller 50, which is coupled to the heating/cooling equipment 30 and the dampers 1-6. The zone demand for each of the zones 1-6 is input to the capacity controller 50 along with equipment limit information and noise limits for each of the zones 1-6. As mentioned above, the noise limit for each zone is predefined and defines an amount of the environmental control effect permitted to affect the zone or, more particularly, the amount of the generated air flow permitted to flow into the zone. Based on the zone demand for each zone and the available capacity and, in some cases, the equipment limit information and/or the noise limit for each zone, the capacity controller 50 provides commands to the dampers 1-6 that instruct each of the dampers 1-6 to assume one of multiple damper positions. The capacity controller 50 further controls operations of the heating/cooling equipment 30 by providing commands to the heating/cooling equipment 30 that instruct the heating/cooling equipment 30 to operate at a particular speed, mode and/or stage.

Since the capacity controller 50 controls the dampers 1-6 based on zone demand and available capacity and, in some cases, the equipment limit information and/or the noise limits, the capacity controller 50 exerts more accurate control of the dampers 1-6 and uses less controlled actuation to do so. As such, the zone demand for each zone is met more precisely by the capacity controller 50 than by zone controllers of the prior art and the dampers 1-6 are manipulated less frequently than current dampers. This increases system efficiency and extends the lifetime of the dampers 1-6.

The heating/cooling equipment 30 can be controlled by the capacity controller 50 in multiple ways. For example, the capacity controller 50 may control an operational speed of the blower 33, the capacity controller 50 may actuate an individual stage of the heating/cooling equipment 30 discretely through a duty cycle and/or the capacity controller 50 may employ variable speed actuation of the heating/cooling equipment 30.

Figure 3:
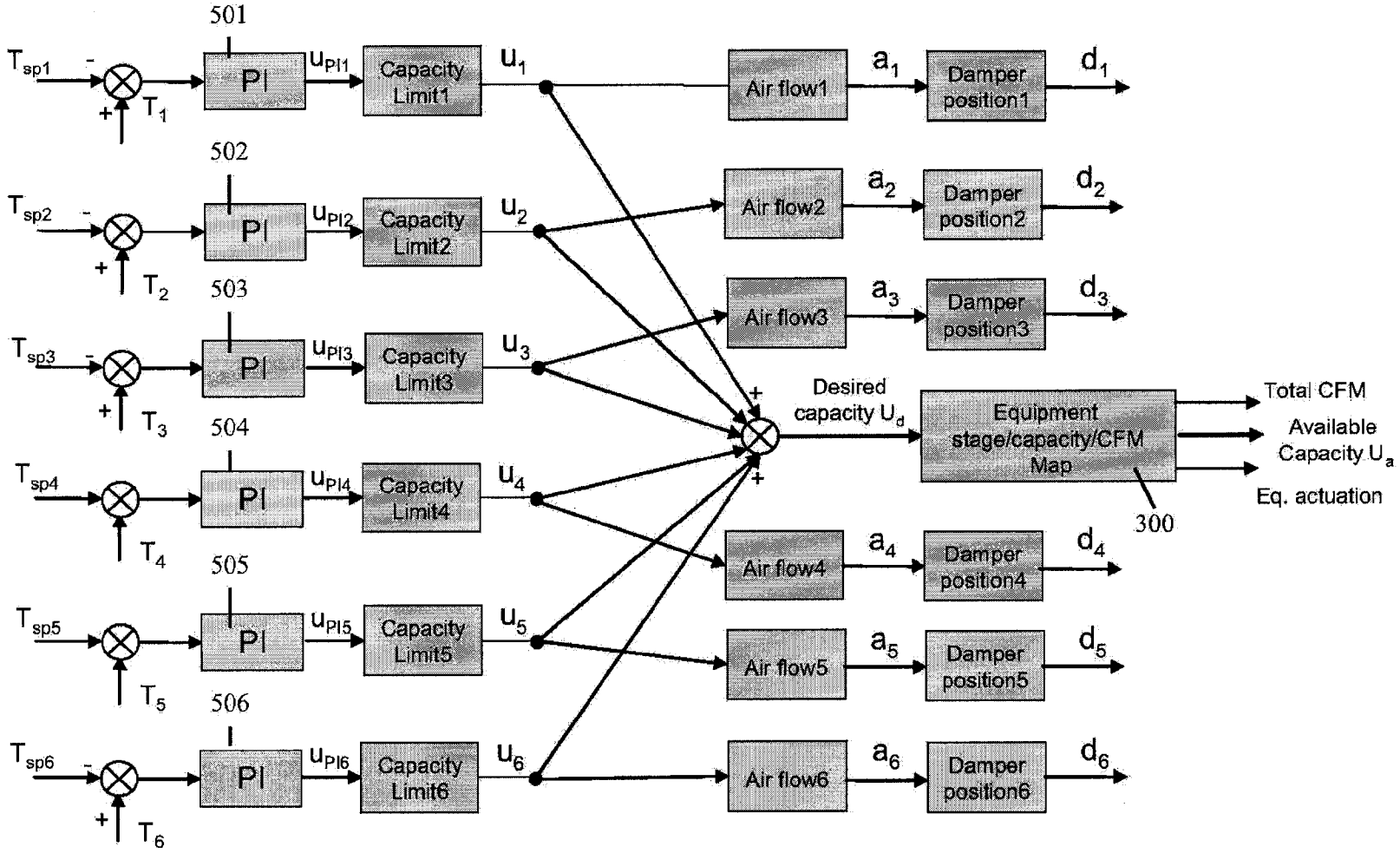
FIG. 3 is a schematic diagram of the capacity controller of the temperature control system of FIG. 2.

With reference to FIG. 3, a schematic diagram of the capacity controller 50 is provided. As shown, the zone demand is defined for each zone as $T_i-T_{spi}$ for cooling situations and $T_{spi}-T_i$ for heating situations where the environmental control effect is a cooling air flow and a heating air flow, respectively. This zone demand is satisfied through the capacity controller 50, which includes a proportional integral (PI) controller for each zone (501, 502, 503, 504, 505, 506). Thus, the zone demand for each zone is satisfied through the corresponding PI controller with a capacity limit function that serves as an anti-windup structure. The set of capacity limit functions cover the air flow limits or noise limits and total equipment capacity limit. From the capacity limit function for each PI controller of each zone, $u_i$ (where i=1, 2, 3, 4, 5, 6), which is the respective portion of the total zone demand for each zone, is converted to air flow $a_i$ through the following formula: $a_i$=(Total air flow)*$U_i/U_d$.

From air flow $a_i$ to damper position $d_i$, the damper position function calculates the damper opening position for each zone and in some cases re-scales the damper opening positions for each damper 1-6 to make sure that at least one damper is fully opened. This is accomplished as follows. First, air flow to each zone is scaled with $u_{ri}=a_i/MaxCFM_i$, where $MaxCFM_i$, is a maximum allowable air flow limit in cubic feet per minute for zone i (where again i=1, 2, 3, 4, 5, 6). Then, the damper position for each damper is calculated with $d_i=15/\max(u_{r1}, u_{r2}, u_{r3}, u_{r4}, u_{r5}, u_{r6})$, where 15 represents the fully opening position of a damper in this example.

The heating/cooling equipment 30 stage/Capacity/CFM Map block 300 in FIG. 3 illustrates that the desired capacity $U_d$ is then converted to the total CFM (i.e., air flow in cubic feet per minute), which is used to control the speed of the blower 33, the available capacity $U_a$, which is used for anti-windup functions as described below, and the equipment stage information. The equipment stage information helps to determine which heating/cooling equipment 30 stage is to be used and for discrete type actuation, which is implemented through a duty cycle method, or speed actuation for variable speed actuation.

Figure 4:
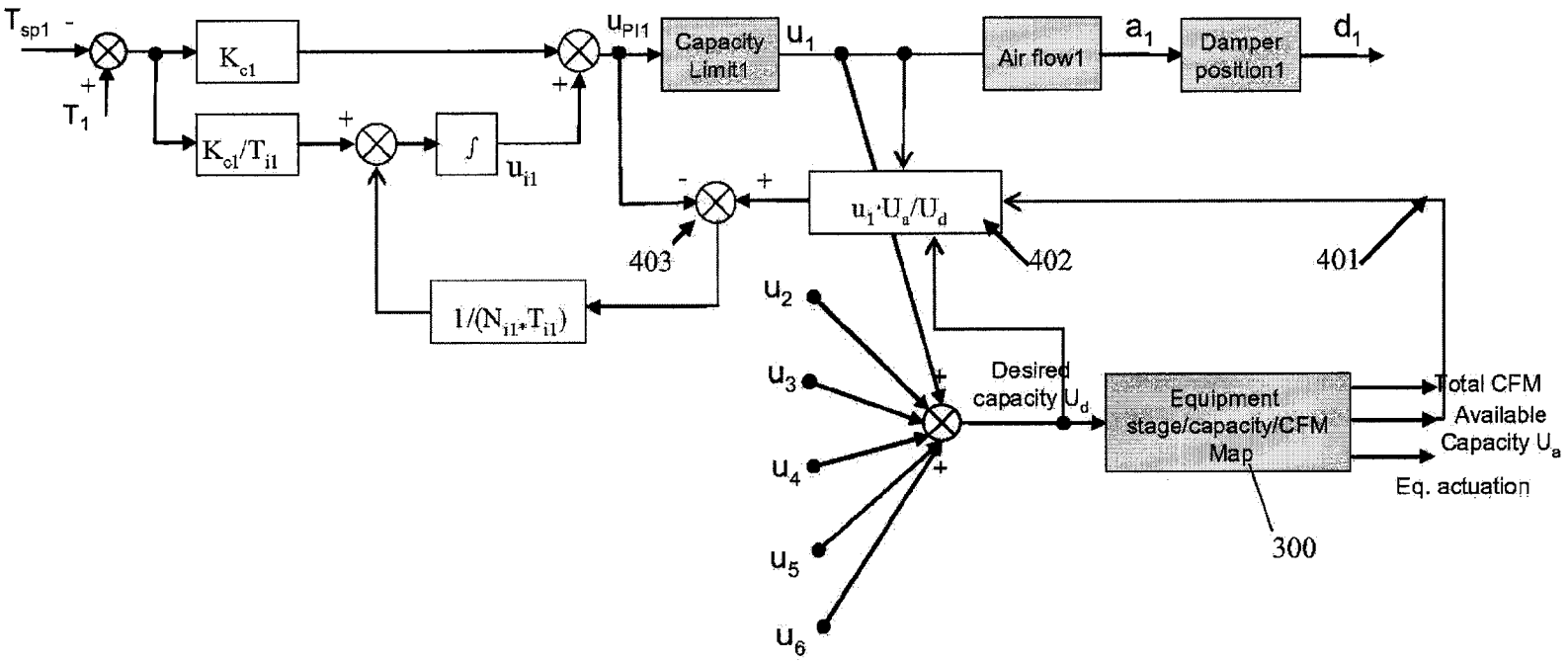
FIG. 4 is a schematic diagram of an anti-windup technique to be employed by the capacity controller of FIGS. 2 and 3.

An anti-windup technique, as illustrated in FIG. 4, may be employed for each zone's PI controller 501, 502, 503, 504, 505, 506 of the capacity controller 50 where $K_{c1}$ and $T_{i1}$ are proportional gain and integral time parameters and $N_{i1}$ is the anti-windup tuning parameter. As shown in FIG. 4, the available capacity $U_a$ is output from the heating/cooling equipment 30 stage/Capacity/CFM Map block 300 along schematic line 401 and at block 402 is multiplied by $u_i$ and divided by $U_d$. The result of that operation is subtracted at point 403 by $U_{PIi}$, which is representative of the zone demand of each zone, and the result of that operation is converted by the proportional gain parameter, the integral time parameter and the anti-windup parameter in accordance with known methods. The results of the anti-windup technique are fed back into the control algorithm for each PI controller of each zone. This feedback thus moderates the zone demand $u_i$ and the damper position $d_i$.

As such, multi-zone temperature requirements for different heating/cooling equipment can be satisfied, zone noise limits (local limits) and equipment capacity limits (global limit) can be handled systematically and local zone temperature controllers can be separated from capacity equipment. That is, local controller tuning parameters are not related to the heating/cooling equipment 30. Therefore, control architecture can be simplified while temperature performance is improved.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An environmental control system, comprising:

equipment to generate an environmental control effect;

a damper associated with a zone to control a portion of the environmental control effect permitted to affect the zone by assuming one of various damper positions; and a capacity controller operably coupled to the equipment and the damper to control operation of the equipment and to adjust the damper to assume the one of the various damper positions in accordance with an anti-windup structure and based on a demand and a noise limit of the zone and an equipment capacity limit, the anti-windup structure being configured to:

multiply and divide an available capacity output from the equipment by a portion of total zone demand for each zone and a desired capacity, respectively, to obtain a first result, subtract a zone demand representation of a difference between a set point and an actual temperature from the first result to obtain a second result, and feed the second result into a PI controller with a control algorithm for controlling the equipment and the damper.

2. The environmental control system according to claim 1, wherein the capacity controller further controls the operation of the equipment and adjusts the damper to assume the one of the various damper positions based on a noise limit of the zone.

3. The environmental control system according to claim 2, wherein the noise limit of the zone refers to noise produced by air flow into the zone and is defined as an amount of air flow to be permitted to flow into the zone via the damper.

4. The environmental control system according to claim 1, wherein the equipment comprises a coil, a blower and one or more of a heat pump, a furnace and an electrical heater operable in a cooling mode or a heating mode.

5. The environmental control system according to claim 4, wherein the capacity controller controls an operational speed of the blower.

6. The environmental control system according to claim 4, wherein the capacity controller actuates an individual stage of the equipment discretely through a duty cycle.

7. The environmental control system according to claim 4, wherein the capacity controller employs variable speed actuation of the equipment.

8. The environmental control system according to claim 1, further comprising a sensor operably disposed in the zone to determine an environmental condition therein, wherein the demand of the zone is defined in accordance with the determined environmental condition therein and a predefined environmental condition set point.

9. A multi-zone environmental control system, comprising:

equipment to generate an environmental control effect;

a plurality of dampers respectively associated with a plurality of zones to each control a portion of the environmental control effect permitted to affect the corresponding one of the plurality of zones by assuming corresponding ones of various damper positions; and a capacity controller operably coupled to the equipment and the plurality of dampers to control operation of the equipment, the capacity controller including a plurality of zone controllers to adjust each of the dampers to assume the corresponding ones of the various damper positions in accordance with an anti-windup structure and based on a demand and a noise limit of the corresponding one of the plurality of zones and equipment capacity limits, the anti-windup structure being configured to:

multiply and divide an available capacity output from the equipment by a portion of total zone demand for each zone and a desired capacity, respectively, to obtain a first result, subtract a zone demand representation of a difference between a set point and an actual temperature of each zone from the first result to obtain a second result, and feed the second result into a PI controller with a control algorithm for controlling the equipment and each of the dampers.

10. The multi-zone environmental control system according to claim 9, wherein the capacity controller further controls the operation of the equipment and adjusts each of the dampers to assume the corresponding ones of the various damper positions based on a noise limit of each of the corresponding one of the plurality of zones.

11. The multi-zone environmental control system according to claim 10, wherein the noise limit of the corresponding one of the plurality of zones refers to noise produced by air flow into the corresponding one of the plurality of zones and is defined as an amount of air flow to be permitted to flow into each of the corresponding one of the plurality of zones via the corresponding damper.

12. The multi-zone environmental control system according to claim 9, wherein the plurality of zones is defined as two or more zones and the plurality of dampers comprises two or more dampers, one in each of the two or more zones.

13. The multi-zone environmental control system according to claim 9, wherein the equipment comprises a coil, a blower and one or more of a heat pump, a furnace and an electrical heater operable in a cooling mode or a heating mode.

14. The multi-zone environmental control system according to claim 13, wherein the capacity controller controls an operational speed of the blower.

15. The multi-zone environmental control system according to claim 13, wherein the capacity controller actuates an individual stage of the equipment discretely through a duty cycle.

16. The multi-zone environmental control system according to claim 13, wherein the capacity controller employs variable speed actuation of the equipment.

17. The multi-zone environmental control system according to claim 9, further comprising sensors operably disposed in each of the plurality of zones to determine respective environmental conditions therein.

18. The multi-zone environmental control system according to claim 17, wherein the demand of the corresponding one of the plurality of zones is defined in accordance with the determined respective environmental conditions therein and respective predefined environmental condition set points.

* * * * *